US006823157B2

(12) United States Patent
Foltz

(10) Patent No.: US 6,823,157 B2
(45) Date of Patent: Nov. 23, 2004

(54) CHARGING DEVICE HAVING CURVED GRID

(75) Inventor: Steven A. Foltz, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/171,287

(22) Filed: Jun. 13, 2002

(65) Prior Publication Data

US 2003/0231901 A1 Dec. 18, 2003

(51) Int. Cl.[7] ..... G03G 15/02

(52) U.S. Cl. ..... 399/171; 399/172; 399/173; 250/324

(58) Field of Search ..... 399/168, 170, 399/171, 172, 173; 250/324, 325, 326; 361/229, 230; 29/592, 592.1

(56) References Cited

U.S. PATENT DOCUMENTS

| | | | | | |
|---|---|---|---|---|---|
| 3,959,690 | A | * | 5/1976 | Leibrecht | 361/230 |
| 4,725,732 | A | | 2/1988 | Lang et al. | 250/326 |
| 5,206,784 | A | * | 4/1993 | Kimiwada et al. | 399/171 |
| 5,241,344 | A | * | 8/1993 | Takano | 250/324 |
| 5,257,073 | A | * | 10/1993 | Gross et al. | 250/324 |
| 5,539,205 | A | * | 7/1996 | Reale | 250/326 |
| 5,812,359 | A | * | 9/1998 | Gross et al. | 250/324 |
| 5,845,179 | A | | 12/1998 | Damji et al. | 399/173 |
| 6,275,669 | B1 | * | 8/2001 | Hasegawa | 399/90 |

FOREIGN PATENT DOCUMENTS

| | | | | |
|---|---|---|---|---|
| JP | 62-269176 | * | 11/1987 | |
| JP | 06067516 A | * | 3/1994 | G03G/15/02 |

* cited by examiner

*Primary Examiner*—Hoan Tran
(74) *Attorney, Agent, or Firm*—Lloyd F. Bean, II

(57) ABSTRACT

A corona generating device, includes a conductor; a grid having a curved surface; and a frame for supporting the grid.

11 Claims, 4 Drawing Sheets

CHARGING DEVICE HAVING CURVED GRID

This invention relates generally to a corona generating device, and more particularly concerns a method and apparatus for mounting a lightweight, low cost grid on a corona generating device.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith.

Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. In printing machines such as those described above, corona devices perform a variety of other functions in the printing process.

For example, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions. One form of a corona charging device comprises a corona electrode in the form of an elongated wire connected by way of an insulated cable to a high voltage AC/DC power supply.

The scorotron is similar to the pin corotron, but is additionally provided with a screen or control grid disposed between the coronode and the photoconductive member. The screen is held at a lower potential approximating the charge level to be placed on the photoconductive member. The scorotron provides for more uniform charging and prevents over charging.

It is desirable to be able to easily assemble each of the above described devices and to accurately locate and install the grid member of the corona generating device.

Other features of the present invention will become apparent as the following description proceeds and upon reference to the drawings, in which.

Figure 1:
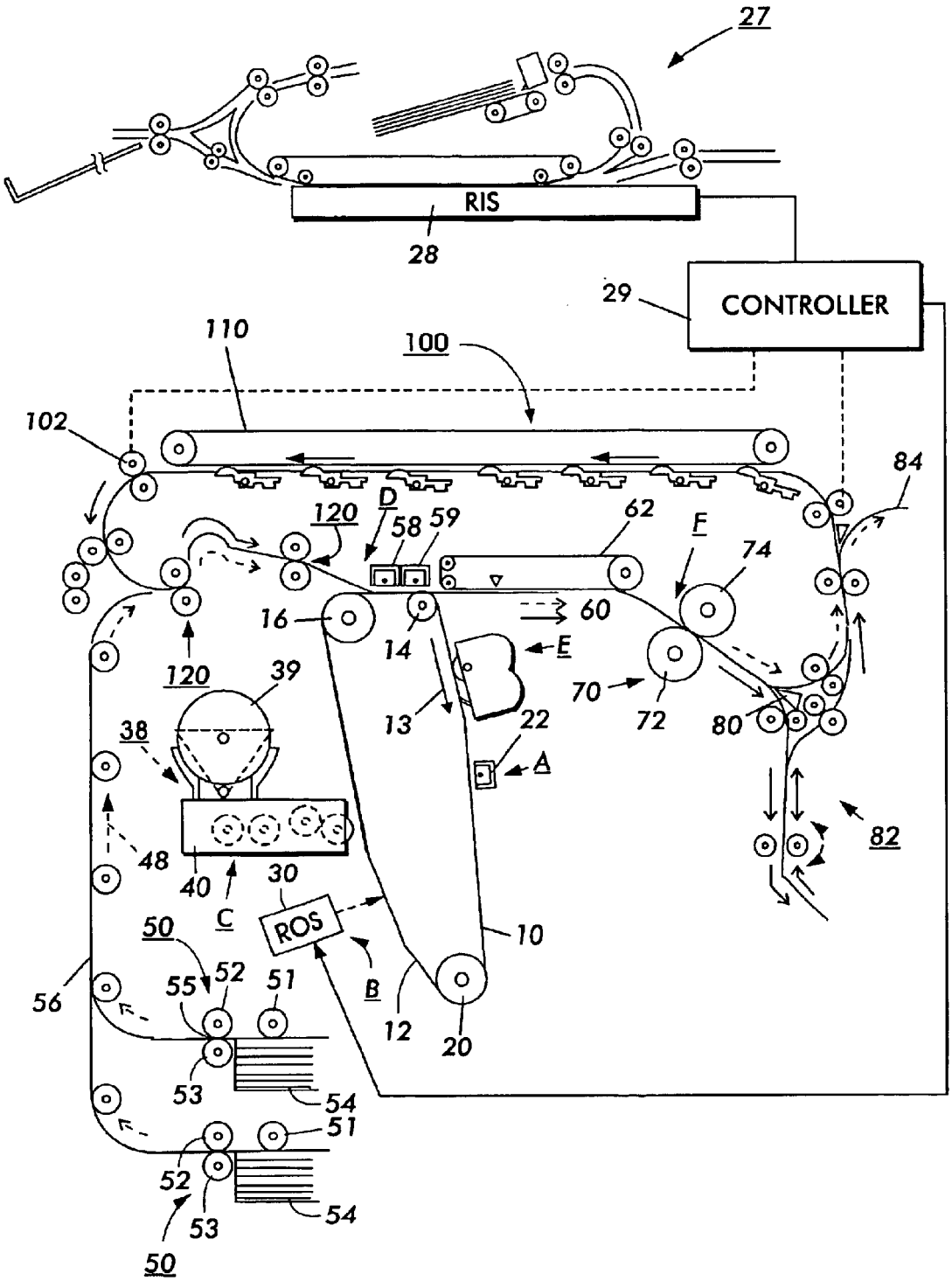
FIG. 1 is a schematic elevational view of a typical electrophotographic printing machine utilizing the corona shield of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

FIG. 1 schematically depicts an electrophotographic printing machine incorporating the features of the present invention therein. It will become evident from the following discussion that the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below. FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13. Initially, a portion of the photoconductive surface passes through charging station A.

At charging station A, a corona generating device indicated generally by the reference numeral 22 charges the photoconductive belt 10 to a relatively high, substantially uniform potential. At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks.

The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis. After the electrostatic latent image has been recorded on photoconductive surface 12, belt 10 advances the latent image to a development station, C, where toner, in the form of liquid or dry particles, is electrostatically attracted to the latent image using commonly known techniques.

The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56.

Vertical transport 56 directs the advancing sheet 48 of support material into the registration transport 120, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72. The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84.

However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for re-circulation back through transfer station D and fuser 70 for receiving and permanently fixing the side two image to the backside of that duplex sheet, before it exits via exit path 84. After the print sheet is separated from photoconductive surface 12 of belt 10, the residual toner/developer and paper fiber particles adhering to photoconductive surface 12 are removed therefrom at cleaning station E.

Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being re-circulated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
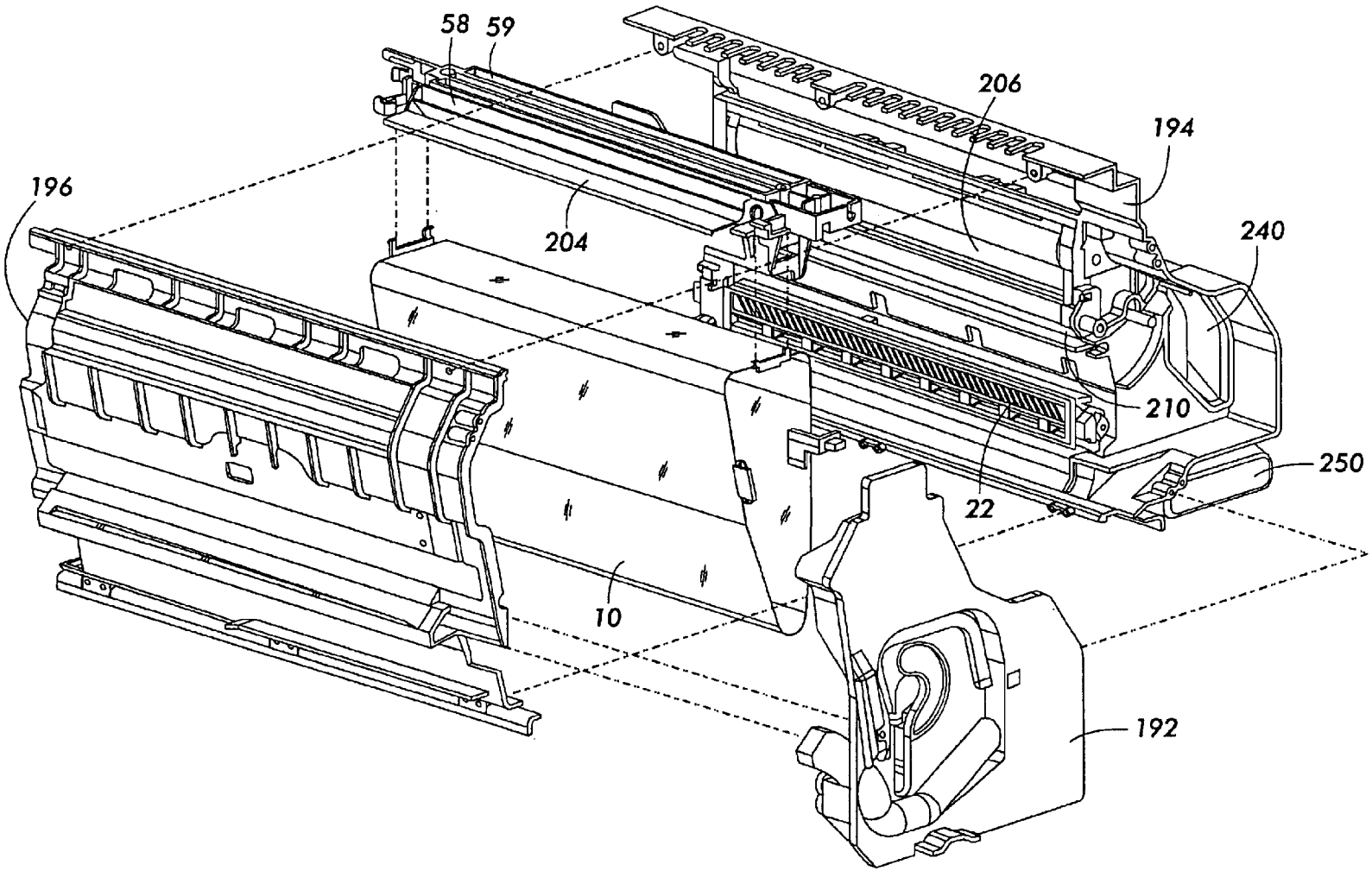
FIG. 2 is an exploded perspective view of the xerographic CRU module further illustrating the components thereof.

Turning next to FIG. 2, there is illustrated a perspective exploded view of a xerographic customer replaceable unit (CRU). The xerographic CRU module mounts and locates xerographic subsystems in relationship to the photoreceptor module 300 and xerographic subsystem interfaces. Components contained within the xerographic CRU include the transfer/detack corona generating devices 58, 59, the pretransfer paper baffles 204, the photoreceptor cleaner 206, the charge scorotron 22, the erase lamp 210, the photoreceptor (P/R) belt 10, the noise, ozone, heat and dirt (NOHAD) handling manifolds 230 and filter 240, the waste bottle 250, the drawer connector 260, CRUM, the automatic cleaner blade engagement/retraction and automatic waste door open/close device (not illustrated). The CRU subsystems are contained within the xerographic housing 190. The housing consist of three main components which include the front end cap 192, right side housing 194 and left side housing 196.

The xerographic housing is a mechanical and electrical link. It establishes critical parameters by mounting and locating subsystems internal and external to the CRU in relationship to the photoreceptor module 300 and other xerographic subsystem interfaces. The housing allows easy reliable install and removal of the xerographic system without damage or difficulty.

Figure 3:
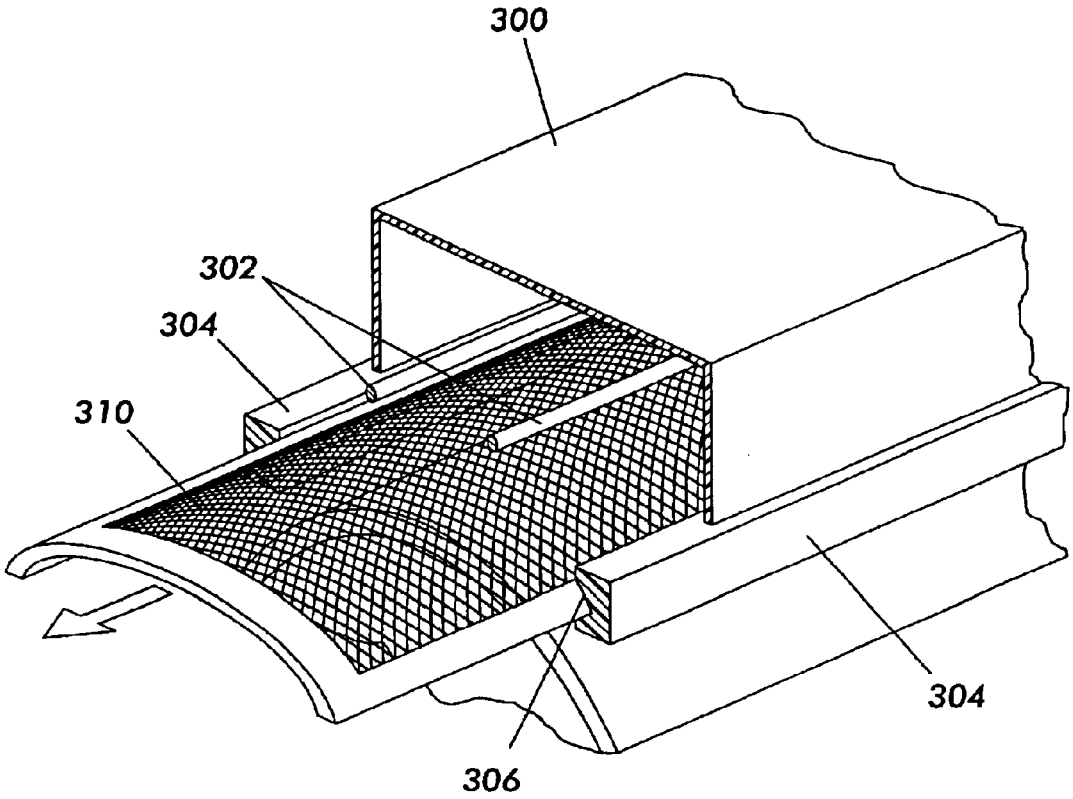
FIGS. 3 and 4 are schematic end views illustrating the method of installing the corona grid.
Figure 4:
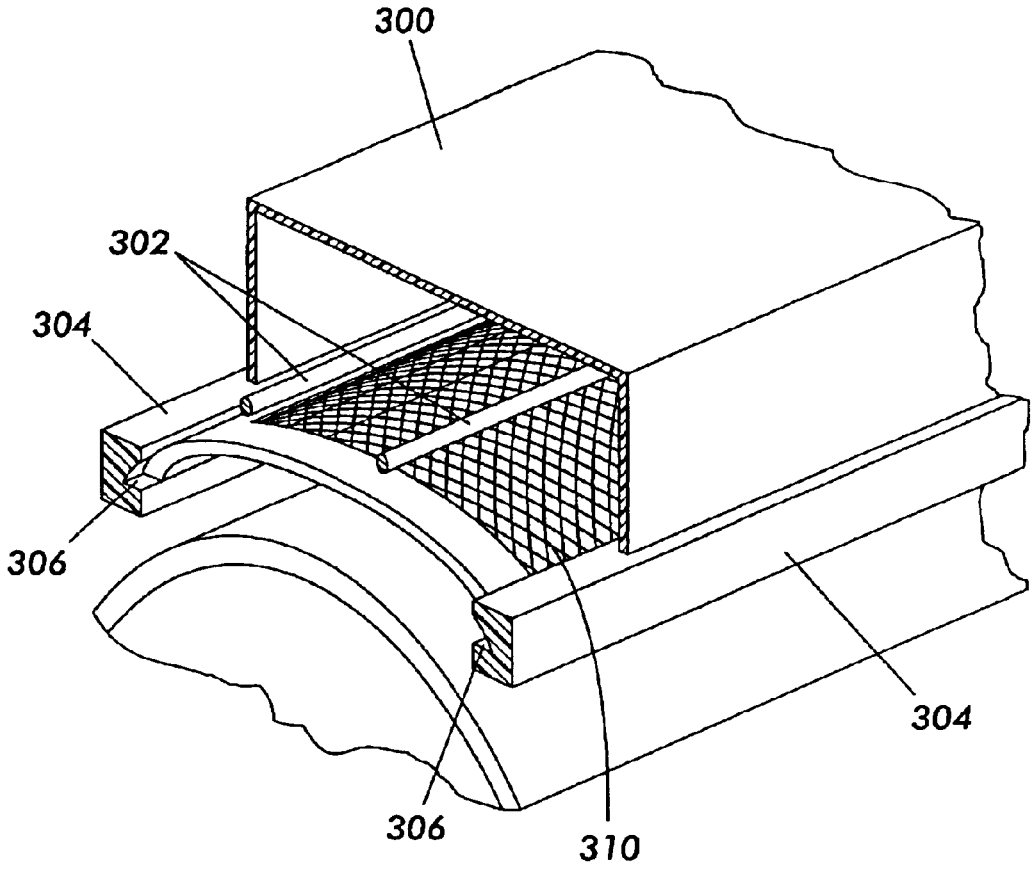

Turning next to FIGS. 3 and 4 there is shown a schematic end view of the lightweight curved grid of the present invention. As illustrated the grid 310, is curved due to the resiliency of the material being compressed, in the illustrated case, prior to installation in the frame 304. Frame 304 has a groove 306 which is angled which supports grid 310 therein and is supported by shield 300. The grid 310 is larger than the width of the frame 304 and is squeezed together and inserted into the frame 304 by moving it in the direction of arrow. Once within the frame 304, the grid 310 is retained due to the tendency to try to return to the flat position. It is also possible to construct or fabricate the grid member from a conductive plastic material or other lightweight, resilient conductive material.

The charging devices includes end blocks (not shown), which support conductors 302. The figure illustrates wire conductors 302 for corona generation. However, pin type conductors may also be employed which comprises an array of pins integrally formed from a sheet metal member.

Preferably the grid is mounted in compression causing the grid to bow or curve to mimic the curvature/radius of the photoreceptor belt or drum. This provides the benefit of a wider charge zone which offers better uniformity and increased redundancy of charge leveling on the photoreceptor. The curved grid would allow the wire/pin array to photoreceptor gap to be smaller which in turn will allow more current to the photoreceptor for a given voltage ie: increased power supply efficiency. However, grid 310 could also be preformed to mimic the curvature/radius of the photoreceptor belt or drum and slide into frame 304.

The grid for the corona-generating device is made of a lightweight, thin conductive material such as stainless steel and are formed so that they have a generally flat cross section prior to installation in the frame. To install the grid is squeezed together and inserted in the frame. Once released the resilient bias of the steel causes the grid to be restrained within the frame. The grid described allows easy and accurate assembly of the corona-generating device.

It is, therefore, apparent that there has been provided in accordance with the present invention, a lightweight easily installed grid that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A corona generating device, comprising:

a conductor;

a planar grid; and a frame, having a first wall and a second wall, for supporting said grid, said grid being positioned in a groove defined in said first wall and said second wall and biased into engagement between said first wall and said second wall in said frame, wherein the beam strength of said grid provides a curved surface with the biasing force to maintain said grid in proper spatial relationship to said frame and said conductor.

2. A corona generating device according to claim 1, wherein said curved surface substantially mimic the curvature/radius of surface to be charged.

3. A corona-generating device according to claim 1 wherein said conductor comprises a wire.

4. A corona-generating device according to claim 1 wherein said conductor comprises an array of pins integrally formed from a sheet metal member.

5. A corona-generating device according to claim 1 wherein said frame has angled groove to support said grid.

6. A method of installing and retaining a grid in a corona generating device, comprising: compressing a planar grid member so that the planar grid member has a predefined curved surface and inserting the planar grid member into a groove defined in a first wall and a second wall of a frame member; releasing the grid member so that the resiliency of the grid member biases the grid member into position and retains the grid member with said predefined curved surface within, the frame member.

7. An electrographic printing machine having a corona generating device, comprising:

a planar grid, a conductor; and a frame, having a first wall and a second wall, for supporting said grid, said grid being positioned in a groove defined in said first wall and said second wall and biased into engagement between said first wall and said second wall in said frame, wherein the beam strength of said grid provides a curved surface with the biasing force to maintain said grid in proper spatial relationship to said frame and said conductor.

8. A corona generating device according to claim 7, wherein said curved surface substantially mimic the curvature/radius of surface to be charged.

9. A corona-generating device according to claim 7 wherein said conductor comprises a wire.

10. A corona generating device according to claim 7 wherein said conductor comprises an array of pins integrally formed from a sheet metal member.

11. A corona generating device according to claim 7 wherein said frame has angled groove to support said grid.

* * * * *